United States Patent [19]

Grosz-Röll et al.

[11] 4,211,277

[45] Jul. 8, 1980

[54] HEAT EXCHANGER HAVING INTERNAL FITTINGS

[75] Inventors: Friedrich Grosz-Röll, Zurich; Gerhard Schütz; Felix Streiff, both of Winterthur, all of Switzerland

[73] Assignee: Sulzer Brothers Ltd., Winterthur, Switzerland

[21] Appl. No.: 908,696

[22] Filed: May 23, 1978

[30] Foreign Application Priority Data

May 31, 1977 [CH] Switzerland ..... 6641/77
Feb. 16, 1978 [CH] Switzerland ..... 1686/78

[51] Int. Cl.[2] ..... F28F 13/12

[52] U.S. Cl. ..... 165/109 T; 138/38; 138/42; 165/154; 366/337

[58] Field of Search ..... 138/38, 42; 165/109, 165/109 T, 154, 156, 174; 366/337

[56] References Cited

U.S. PATENT DOCUMENTS

| | | | |
|---|---|---|---|
| 166,180 | 8/1875 | Bailey | 138/38 |
| 2,488,615 | 11/1949 | Arnold | 138/38 |
| 2,709,128 | 5/1955 | Krause | 138/38 |
| 3,234,755 | 2/1966 | Richelli | 165/174 |
| 3,235,003 | 2/1966 | Smith | 138/38 |
| 3,652,061 | 3/1972 | Chisholm | 366/337 |
| 3,743,250 | 7/1973 | Fitzhugh, Jr. et al. | 138/38 |
| 3,827,676 | 8/1974 | Brasie | 366/337 |
| 4,093,188 | 6/1978 | Horner | 366/337 |

FOREIGN PATENT DOCUMENTS

| | | | |
|---|---|---|---|
| 86622 | 6/1895 | Fed. Rep. of Germany | 138/38 |

*Primary Examiner*—Sheldon Richter
*Attorney, Agent, or Firm*—Kenyon & Kenyon

[57] ABSTRACT

The heat exchanger is constructed with a plurality of fittings which are disposed in the flow passage. Each fitting is constructed of at least two groups of webs with the webs of each group disposed in spaced parallel relation and in angular relation to the axis of the flow passage. Also, each group of webs is disposed in crossing relation to the webs of the other group. The ratio of web width (b) to diameter (d) of the flow passage is in the range of from 0.08 to 0.5 while the ratio of web spacing (m) to the diameter (d) is in the range of from 0.38 to 0.9. The fittings permit improved heat transfer with reduced pressure losses and a relatively small total area.

16 Claims, 9 Drawing Figures

HEAT EXCHANGER HAVING INTERNAL FITTINGS

This invention relates to a heat exchanger and, more particularly, to a heat exchanger having a plurality of fittings therein.

As is known, every endeavor is made to construct heat exchangers so that a high heat transfer can be obtained from a first medium to a second medium through a heat-transmitting wall with a minimum of pressure loss. Further, in order to improve the heat transfer, it is also known to take advantage of those places in the heat exchangers where there is a maximum heat resistance. For example, in the case of an empty flow passage formed between two concentric tubes, internal fittings of different geometric shapes have been used in order to increase the heat transfer capacity in the flow passage. However, these fittings have led to very different results.

For example, in one case, it has been known to provide tubes with fins or corrugated metal strips connected to the tube wall in order to increase the size of the heat transmitting surface of the tubes. Although this can increase the heat transfer capacity, it is impossible to avoid the deposition of solid particles entrained by the media undergoing heat exchange.

It has also been known to provide displacement members in empty tubes used as heat exchangers. Such a construction, however, can be applied economically only if there are small quantities of medium taking part in the heat exchange and if the medium is a pure medium. Otherwise, the relatively narrow gaps formed between the displacement members and the tube wall can be clogged by deposits.

Also, it has been known that the known fittings together with the tube wall have a relatively large area. Hence, it is impossible to avoid considerable pressure losses.

Accordingly, it is an object of the invention to achieve a high heat transfer capacity and low pressure loss with a minimum total surface in a heat exchanger.

It is another object of the invention to provide a heat exchanger with internal fittings which provide a high heat transfer capacity and low pressure loss with a minimum total surface area.

It is another object of the invention to provide a heat exchanger with internal fittings capable of transferring heat for media having solid particles, for viscous media such as molten plastics, adhesives, oils, and foods such as fats.

It is another object of the invention to provide a heat exchanger which can be suitably constructed for use with flowable media of viscous nature.

Briefly, the invention provides a heat exchanger which is comprised of a means, such as a tube, which defines a flow passage along a longitudinal axis and a plurality of fittings disposed in the flow passage. Each fitting includes at least two groups of webs with the webs of each group disposed in parallel relation to each other at a predetermined spacing (m), in angular relation to the flow passage axis and in crossing relation to the webs of the other group. At least some of the webs are interconnected to each other at the points of intersection.

Where the tube has a predetermined diameter (d), each web has a web width (b) which is in a ratio in the range of from 0.08 to 0.5 relative to the diameter (d) of the flow passage. In addition, the ratio of the web spacing (m) in each group to the diameter (d) is in the range of from 0.38 to 0.9.

The flow passage may alternatively be constructed with a square cross-section. In this case, the diameter (d) is taken as the cross-sectional width of the passage.

Each group of webs may consist of a number of webs disposed one after the other in parallel relationship on the longitudinal axis of the flow passage. In addition, a number of webs may disposed in the same plane for each web.

The advantage of the embodiment in which a number of webs are situated in the same plane is ease of cleaning and very simple manufacture. The structure of the fittings is determined by the design criteria in respect of the ratio of the web width b to the diameter d of the passage and of the ratio of the web spacing m in each group to the passage diameter d. Thus, the statement $b/d=0.5$ means that two webs are disposed over the same cross-section in the web, while in the case of $b/d=0.08$ 12 webs are provided.

The web density in the direction of the passage axis and hence the total web area are determined by the ratio of the web spacing m in each group to the passage diameter d.

The spacing m between each pair of webs disposed in parallel relationship one after the other in the direction of the passage axis in each group denotes the vertical spacing between the web planes.

It has been found experimentally that with internal fittings having the above features and dimensions, the pressure losses in the flow passage can be greatly reduced and, when applied to a heat-exchanger, the heat transfer capacity can be greatly increased.

In a very advantageous embodiment of the invention, the ratio of the web width b to the passage diameter d is 0.25 and the ratio of the web spacing m in each group to the passage diameter d is 0.64. In this case, four webs are provided in each case in each zone of the flow passage. In this embodiment, heat transfer is achieved with minimum total area and low pressure losses.

It is also advantageous to construct the fittings so that the webs of the individual groups cross one another and include an angle $\alpha$ of opposite sign of 20° to 50°, more particularly 30°, with the passage axis. This angle zone is very favorable with respect to heat transfer and pressure losses, as has been found experimentally.

Advantageously, at least two internal fittings are disposed one after the other in the passage of the heat exchanger, the adjacent fittings being turned through an angle of preferably 90° to one another with respect to the passage axis. Excellent transverse mixing of the medium can thus be obtained in the passage.

The medium particles guided from the inside of the passage to the wall of the passage by means of the fittings constantly destroy the interface at the passage wall. Thus, new particles continually come into contact with the passage wall from the interior of the passage and a uniform temperature level can be achieved over the passage cross-section.

Although the invention is intended to include heat exchangers of the kind in which the outer wall of the passage is cooled or heated by the surrounding air, an advantageous embodiment disposes the flow passage inside a passage jacket area with a first medium flowing through the passage jacket.

A heat exchanger constructed according to the invention has the following main advantages:

(a) a favorable ratio between heat transfer and pressure drop;

(b) a short residence time and a narrow residence time spectrum for the medium for heating or cooling, due to the reduction of the heat-exchange volume in comparison with known internal fittings, so that the medium is not subjected to rigorous conditions;

(c) easy installation and removal of the fittings in the flow passage—no rigid connection absolutely essential, for example, by soldering or welding to the inner wall of the passage, (d) minimum total area, (e) relatively small space requirements for the heat exchanger due to the increased heat transfer capacity.

The heat exchanger can be used with flow processes in which viscous media, for example media from the plastics industry, e.g. molten plastics, adhesives, oils, and foods such as fats can be heated or cooled, with heating or cooling taking place, of course, in the laminar zone or at least in the transition zone to turbulence. In this case, the wall of the flow passage is formed of an impermeable material.

The heat exchanger may also be constructed so that the wall of the flow passage is formed of a semi-permeable material. In this case, the heat exchangers can be used for osmosis, counter-osmosis or ultra-filtration processes.

These and other objects and advantages of the invention will become more apparent from the following detailed description taken in conjunction with the drawings wherein.

Figure 6D:
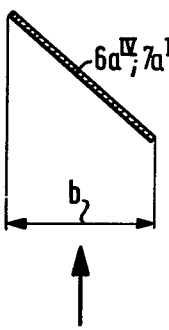
Figure 6C:
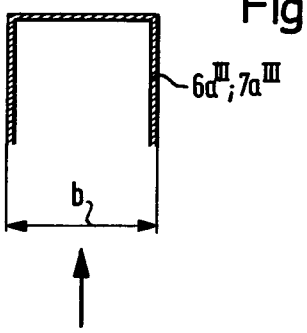
Figure 6B:
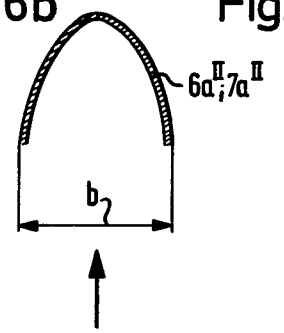
Figure 6A:
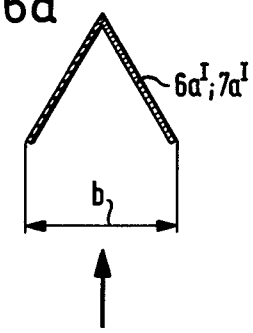

FIG. 6*a* illustrates a web of triangular profile in cross-section in accordance with the invention;

FIG. 6*b* illustrates a web of parabolic profile in accordance with the invention;

FIG. 6*c* illustrates a web of U-shaped profile in accordance with the invention; and FIG. 6*d* illustrates a view of a web disposed at an angle in accordance with the invention.

Figure 1:
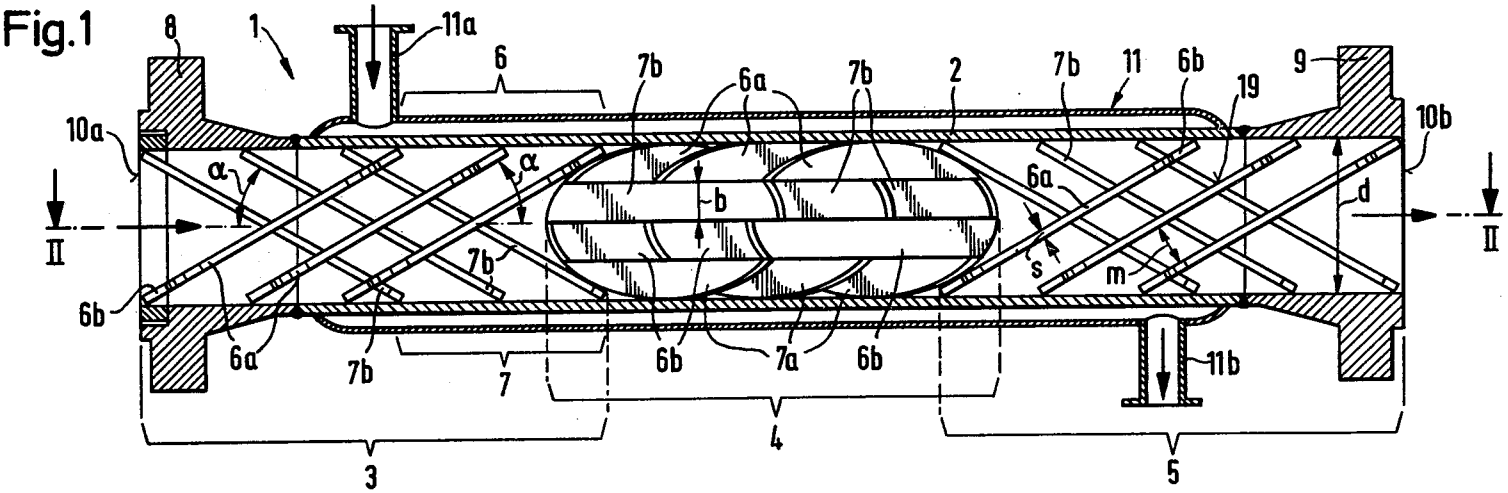
FIG. 1 illustrates a longitudinal sectional view of a heat exchanger having internal fittings and a jacket tube surrounding a flow passage in accordance with the invention.

Referring to FIG. 1, the heat exchanger 1 is comprised of a single tube defining a tubular flow passage 2 of predetermined diameter (d) along a longitudinal axis of the passage. In addition, the heat exchanger 1 contains three internal fittings 3, 4, 5 disposed one after the other within the flow passage 2. The consecutive fittings 3, 4, 5 are turned 90° with respect to the passage axis. Each fitting includes two groups 6, 7 of webs. The webs 6*a, 6b; 7a, 7b* of each group 6, 7 are inclined by an angle $\alpha$ with respect to the longitudinal axis of the flow passage with the angle of inclination of the group 6 having an opposite sign to that of the group 7. In this way, the webs of the two groups 6, 7 cross one another. The webs of each group 6, 7 are also disposed in parallel relation to each other within the same plane with the webs 6*a, 6b* passing through the spaces between the webs 7*a, 7b* and with the webs 7*a, 7b* passing through the spaces between the webs 6*a, 6b* so as intersect them.

The tube of the heat exchanger has flanges 8, 9 at the opposite ends for known purposes. In addition, a jacket tube 11 is disposed about the tube of the flow passage 2. This jacket tube 11 is provided with spigots 11*a, 11b* for the supply and discharge of a first medium from which heat is supplied to and discharged from a medium flowing through the flow passage 2. In this regard, a second medium is passed through the flow passage 2 via an inlet aperture 10*a* as indicated by the direction of the arrow, and flows through the fittings 3, 4, 5 to the outlet aperture 10*b*. During travel, this second medium is cooled by the heat transfer with the first medium.

Figure 2:
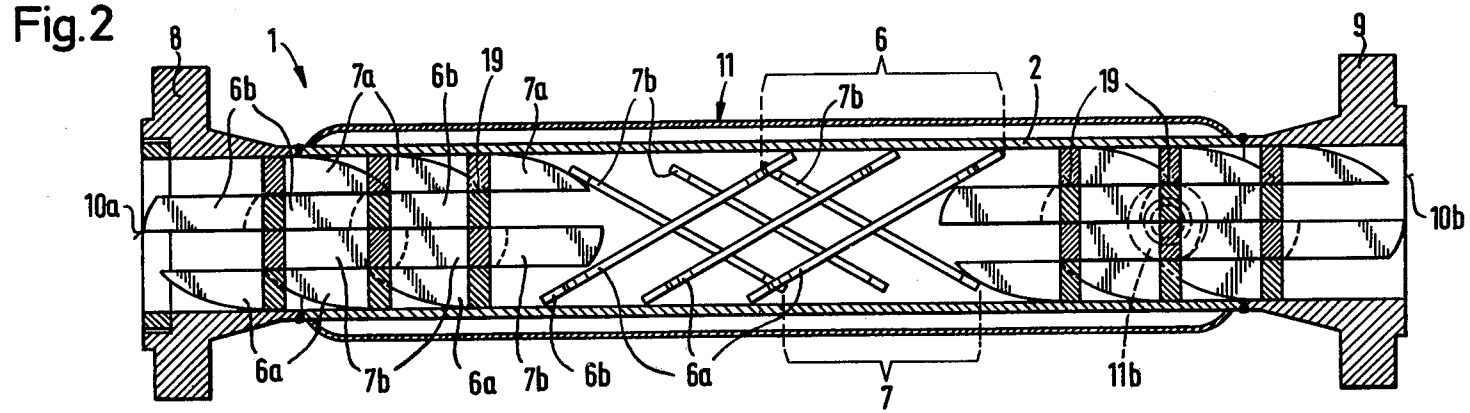
FIG. 2 illustrates a view taken on line II—II of FIG. 1.

Referring to FIG. 2, the respective webs 6*a, 6b; 7a, 7b* intersect or connect at points 19.

Each web is of a width (b) such that the ratio of web width (b) to diameter (d) of the flow passage 2 is in the range of from 0.08 to 0.5. In addition, the ratio of web spacing (m), i.e. the distance between the webs of a group 6,7, to the diameter (d) of the flow passage 2 is in the range of from 0.38 to 0.9. As indicated in FIG. 1, each web is of a thickness s. Also, the contour of the webs in the edge zones is adapted to the circular cross-section of the flow passage 2.

Figure 3:
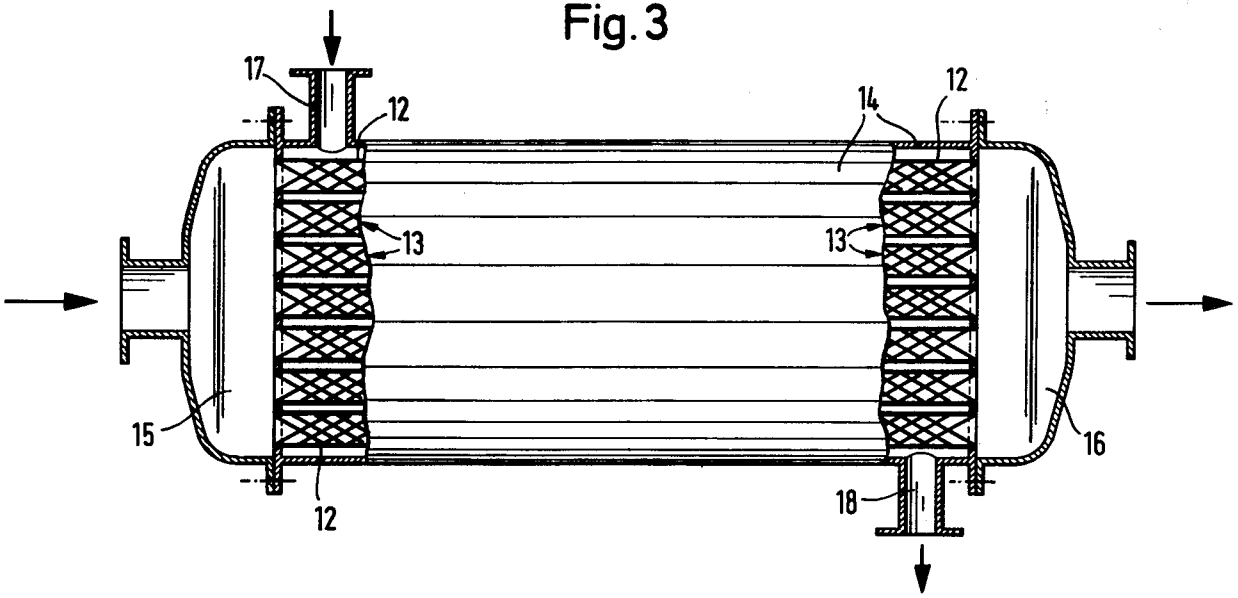
FIG. 3 illustrates a view of a modified heat exchanger having a plurality of flow passages provided with internal fittings in accordance with the invention.

Referring to FIG. 3, the heat exchanger may also be constructed with a number of flow passages 12 disposed within a jacket tube 14 through which a first medium flows. These flow passages 12 are each provided with fittings 13 of a similar construction to that as described with respect to FIG. 1 and are shown only diagrammatically. In addition, a second medium passes into the heat exchanger via a spigot 17 and is discharged via a spigot 18 in known manner.

The medium for treatment may, for example, be a viscous oil while the medium passing through the spigots 17, 18 may be a saturated vapor for cooling water.

Figure 4:
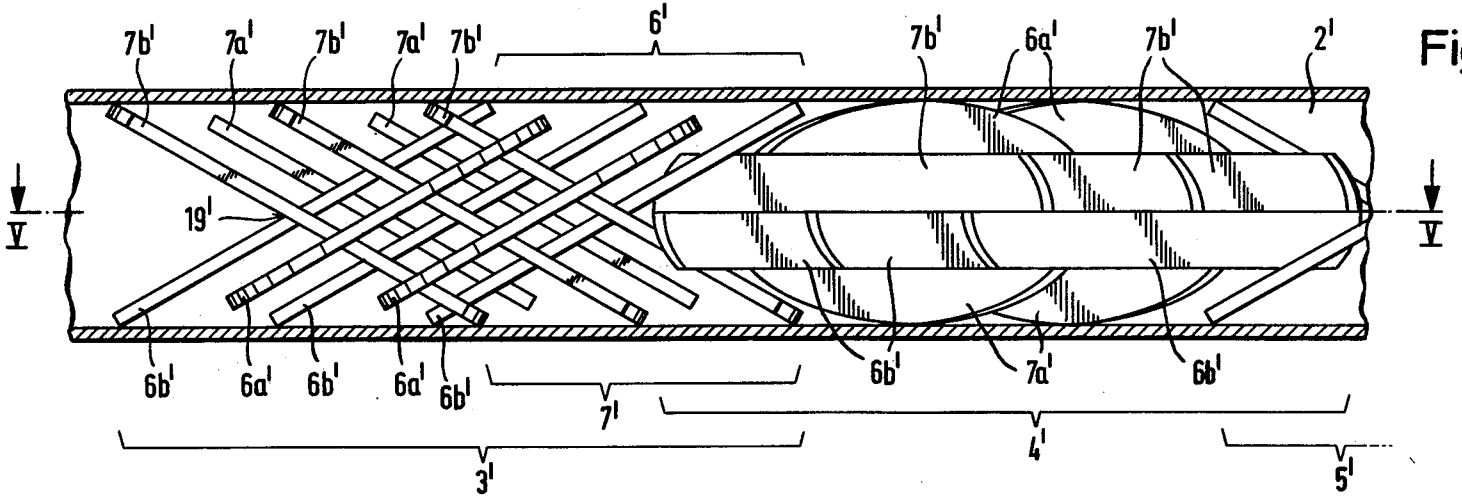
FIG. 4 is a view similar to FIG. 1 of a modified embodiment in which webs are offset from one another in step fashion in accordance with the invention.
Figure 5:
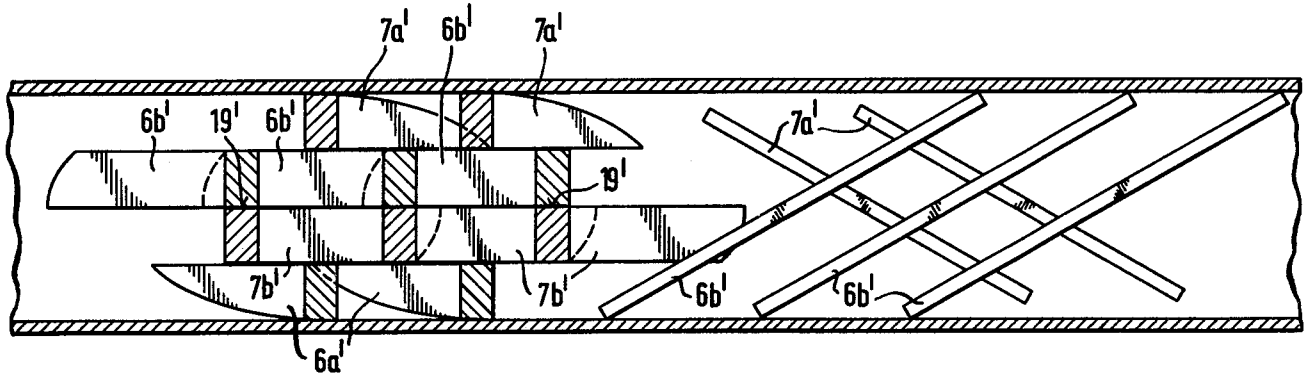
FIG. 5 illustrates a view taken on line V—V of FIG. 4.

Referring to FIGS. 4 and 5, wherein like reference characters indicate like parts as above, the webs 6*a, 6b; 7a, 7b,* need not be in the same plane as in FIGS. 1 and 2 but may be offset from one another in step fashion.

As shown, the flow passages 12 extend from a chamber 15 on the inlet side and a chamber 16 on the outlet side.

In a particularly advantageous construction, each fitting can be made with a ratio of web width to diameter (d) which is in the range of from 0.08 to 0.33 and particularly 0.25 with a ratio of web spacing (m) to diameter (d) of 0.64.

The diameter (d) of the flow passage 2 may be of any suitable size such as from 10 to 200 millimeters. Also, the thickness s of each web may be in the range of from 1 to 4 millimeters.

The webs need not be formed of strip-shaped construction. For example, the webs may have a V-shaped cross-section as shown in FIG. 6*a*, a parabolic or arcate cross-section as shown in FIG. 6*b* or a U-shaped cross-section as shown in FIG. 6*c*. Also, the webs may occupy an inclined position with respect to the direction of flow of the medium as indicated in FIG. 6*d*. The direction of flow is indicated by arrows in FIGS. 6*a–6d*. In principle, the flow may also extend into the reverse direction. Also, the webs need not be constructed with smooth surfaces. Instead, for example, they may have structured surface, for example with grooves. Also, the surfaces may be sanded to produce turbulence on the surfaces to produce better temperature homogenization.

What is claimed is:

1. A heat exchanger comprising means defining a flow passage having a predetermined diameter (d) along a longitudinal axis of said passage; and a plurality of fittings disposed in said flow passage, each said fitting including at least two groups of webs, each group including a plurality of webs, said webs of each group being disposed in parallel relation to each other at a predetermined spacing (m), in angular relation to said flow passage axis and in crossing relation to said webs of the other group, at least some of said webs being interconnected to each other at points of intersection thereof wherein at least two of said fittings are disposed in consecutive relation in said passage and in 90° relation to each other along said longitudinal axis.

2. A heat exchanger comprising means defining a flow passage having a predetermined diameter (d) along a longitudinal axis of said passage; and a plurality of fittings disposed in said flow passage, each said fitting including at least two groups of webs, said webs of each group being disposed in parallel relation to each other at a predetermined spacing (m) in angular relation to said flow passage axis and in crossing relation to said webs of the other group, at least some of said webs being interconnected to each other at points of intersection thereof with each web having a web width (b), wherein the ratio of web width (b) to said diameter (d) is in the range of from 0.08 to 0.33 and wherein the ratio of said web spacing (m) in each said group to said diameter (d) is in the range of from 0.38 to 0.9, and wherein at least two of said fittings are disposed in consecutive relation in said passage and in 90° relation to each other along said longitudinal axis.

3. A heat exchanger as set forth in claim 1 wherein each web crosses at least two other webs with interconnected points of intersection.

4. A heat exchanger as set forth in claim 1 wherein said webs of each group cross said passage axis on an angle of from 20° to 50°.

5. A heat exchanger as set forth in claim 1 wherein said ratio of web width to said diameter is 0.25 and said ratio of web spacing to said diameter is 0.64.

6. A heat exchanger as set forth in claim 1 wherein said webs have a thickness of from 1 to 4 millimeters.

7. A heat exchanger as set forth in claim 1 wherein said diameter is from 10 to 200 millimeters.

8. A heat exchanger as set forth in claim 1 which further comprises a jacket about said passage for a through flow of a medium in heat exchange with a medium passing through said passage.

9. A heat exchanger as set forth in claim 1 wherein said means is a wall of impermeable material.

10. A heat exchanger as set forth in claim 1 wherein said means is a wall of semi-permeable material.

11. A heat exchanger as set forth in claim 1 wherein said passage is of circular cross-section.

12. A heat exchanger as set forth in claim 1 wherein said passage is of rectangular cross-section.

13. A heat exchanger comprising a first tube defining a flow passage having a predetermined diameter along a longitudinal axis;

a plurality of fittings disposed in said tube, each said fitting including at least two groups of webs, said webs of each group being disposed in parallel relation to each other at a predetermined spacing (m), in angular relation to said flow passage axis and in crossing relation to said webs of the other group, at least some of said webs being interconnected to each other at points of intersection thereof with each said web having a web width (b) wherein the ratio of web width (b) to said diameter (d) is in the range of from 0.08 to 0.33 and wherein the ratio of said web spacing (m) in each said group to said diameter (d) is in the range of from 0.38 to 0.9; and a jacket tube disposed about said first tube for a through flow of a medium in heat exchange relation with a medium flowing through said passage.

14. A heat exchanger comprising means defining a flow passage having a predetermined diameter (d) along a longitudinal axis of said passage; and a plurality of fittings disposed in said flow passage, each said fitting including at least two groups of webs, said webs of each group being disposed in parallel relation to each other at a predetermined spacing (m), in angular relation to said flow passage axis and in crossing relation to said webs of the other group, at least some of said webs being interconnected to each other at points of intersection thereof with each said web having a web width (b), wherein the ratio of web width (b) to said diameter (d) is in the range of from 0.08 to 0.33.

15. A heat exchanger as set forth in claim 14 wherein the ratio of said web spacing (m) in each said group to said diameter (d) is in the range of from 0.38 to 0.9.

16. A heat exchanger comprising means defining a flow passage having a predetermined diameter (d) along a longitudinal axis of said passage; and a plurality of fittings disposed in said flow passage, each said fitting including at least two groups of webs, said webs of each group being disposed in parallel relation to each other at a predetermined spacing (m), in angular relation to said flow passage axis and in crossing relation to said webs of the other group, at least some of said webs being interconnected to each other at points of intersection thereof with each said web having a web width (b), wherein the ratio of web width (b) to said diameter (d) is 0.25 and wherein the ratio of said web spacing (m) in each said group to said diameter (d) is 0.64.

* * * * *

UNITED STATES PATENT AND TRADEMARK OFFICE

CERTIFICATE OF CORRECTION

PATENT NO. : 4,211,277

DATED : July 8, 1980

INVENTOR(S) : Friedrich Grosz-Roll & Gerhard Schutz & Felix Streiff

It is certified that error appears in the above—identified patent and that said Letters Patent is hereby corrected as shown below:

Column 4, line 41, delete comma after "7b".

Column 5, line 32, change "each web" to -- each said web --.

Column 6, line 9, change "diameter along" to -- diameter (d) along --.

Signed and Sealed this

*Eleventh* Day of *November 1980*

[SEAL]

*Attest:*

SIDNEY A. DIAMOND

*Attesting Officer*

*Commissioner of Patents and Trademarks*